US005540429A

United States Patent [19]

Dalebout et al.

[11] Patent Number: 5,540,429

[45] Date of Patent: Jul. 30, 1996

[54] ADJUSTABLE HEIGHT BASKETBALL STANDARD WITH TELESCOPING TUBES

[75] Inventors: William T. Dalebout, Logan; Jon Jensen, Providence, both of Utah

[73] Assignee: Icon Health & Fitness, Inc., Logan, Utah

[21] Appl. No.: 176,215

[22] Filed: Dec. 30, 1993

[51] Int. Cl.[6] ..... A63B 63/08

[52] U.S. Cl. ..... 273/1.5 R; 192/8 C

[58] Field of Search ..... 273/1.5 R; 248/404, 248/416, 422, 161; 192/79, 81 R, 81 C, 72, 67 R, 8 C

[56] References Cited

U.S. PATENT DOCUMENTS

| | | | |
|---|---|---|---|
| D. 343,215 | 1/1994 | Grant | D21/201 |
| 1,937,626 | 12/1933 | Briggs | 192/8 C |
| 1,954,221 | 4/1934 | Nicholson | 192/8 C X |
| 2,907,564 | 10/1959 | Wise | 192/8 C X |
| 2,946,417 | 7/1960 | Hungerford, Jr. | 192/8 C |
| 2,986,395 | 5/1961 | Sheftel . | |
| 3,017,183 | 1/1962 | Chalcroft . | |
| 3,427,025 | 2/1969 | Procter | 273/1.5 R |
| 3,722,886 | 3/1973 | Sinner . | |
| 3,802,702 | 4/1974 | Pulley . | |
| 4,145,044 | 3/1979 | Wilson et al. . | |
| 4,330,101 | 5/1982 | Andersen . | |
| 4,412,679 | 11/1983 | Mahoney et al. . | |
| 4,465,277 | 8/1984 | Dittrich . | |
| 4,522,394 | 6/1985 | Broussard | 273/1.5 R |
| 4,526,367 | 7/1985 | Haston et al. | 273/1.5 R |
| 4,623,051 | 11/1986 | Lochmoeller | 192/8 C |
| 4,684,129 | 8/1987 | Andersen et al. . | |
| 4,781,375 | 11/1988 | Nye . | |
| 4,805,904 | 2/1989 | Nye . | |
| 4,881,734 | 11/1989 | Nye . | |
| 4,926,987 | 5/1990 | Honma | 192/8 C |
| 4,951,944 | 8/1990 | Morgan | 293/1.5 R |
| 4,974,841 | 12/1990 | Jarriel et al. . | |
| 5,058,720 | 10/1991 | Rude et al. | 192/8 C X |
| 5,102,128 | 4/1992 | Geise | 273/1.5 R |
| 5,112,023 | 5/1992 | Sowers | 248/519 |
| 5,156,395 | 10/1992 | Smith | 273/1.5 R |
| 5,158,281 | 10/1992 | Williams . | |
| 5,163,676 | 11/1992 | Taub . | |
| 5,207,407 | 5/1993 | Fitzsimmons et al. . | |
| 5,211,368 | 5/1993 | Kitamura | 192/8 C X |
| 5,211,393 | 5/1993 | Rolffs et al. . | |
| 5,232,217 | 8/1993 | Cota et al. | 273/1.5 A |
| 5,238,251 | 8/1993 | Staka . | |
| 5,248,140 | 9/1993 | Matherne et al. . | |
| 5,255,900 | 10/1993 | Wendell . | |
| 5,259,612 | 11/1993 | Matherne et al. . | |

*Primary Examiner*—Paul E. Shapiro
*Attorney, Agent, or Firm*—Trask, Britt & Rossa

[57] ABSTRACT

An adjustable height basketball standard includes a lower tube secured to a ground surface. An upper tube engages the lower tube. A raising and lowering mechanism includes a friction element and engages a handle that may be turned by the user. The friction element substantially resists downward movement of the upper tube unless the friction element is overridden through movement of the handle by the user. The friction element may be a wrap spring, a friction cone clutch, brake plates or shoes, or a similar device. In one embodiment, the upper tube includes a series of notches. A drive mechanism includes a drive housing with a gear that engages successive ones of the notches as the drive housing is turned. When the drive housing is turned clockwise, the upper tube raises with respect to the lower tube, and when the drive housing is turned in counter-clockwise, the upper tube lowers with respect to the lower tube. A spring is wrapped around the drive housing. When the handle is not turned, the spring resists counter-clockwise movement of the drive housing. When the handle turns clockwise, the spring turns with the drive housing. When the handle is turned counter-clockwise, the spring initially resists movement of the drive housing in the counter-clockwise direction. However, after the handle turns about 15 degrees, the spring to be momentarily released. A cable may be used rather than gears.

13 Claims, 7 Drawing Sheets

ADJUSTABLE HEIGHT BASKETBALL STANDARD WITH TELESCOPING TUBES

BACKGROUND OF THE INVENTION

1. Field

The present invention relates to a basketball standard and, in particular, to a basketball standard in which an upper tube telescopes with respect to a lower tube to adjust the height of a backboard.

2. State of the Art

In recent years, basketball standards having an adjustable height backboard have become popular. Three basic arrangements are commonly used. In one arrangement, a supporting pole is embedded in the ground or connected to a movable support. A backboard is connected to the supporting pole by bars arranged in parallelogram. The backboard may be raised or lowered by changing the angle of the bars. A disadvantage of this arrangement is that the bars are relatively short so there is a limited range of heights at which the backboard may be positioned.

In a second arrangement, the backboard is attached to bars that are connected to a supporting pole by a bracket(s), which surrounds the pole. The bracket(s) is selectively tightened around the pole, allowing the bracket(s) to slide up and down the pole, thus raising and lowering the backboard. A disadvantage of this arrangement is the backboard is difficult to raise and lower.

In a third arrangement, which is illustrated in U.S. Pat. No. 4,412,679 to Mahoney, deceased et al., a lower pole is secured to the ground or a moveable support. An upper pole, which supports a backboard, fits partially inside the lower pole. The upper tube telescopes with respect to the lower pole to change the height of the backboard. The upper pole rises under the force of a spring or hydraulic actuator and lowers under the force of gravity. The upper tube is locked at a particular desired height under the force of a locking nut member inserted into the lower tube. A disadvantage of the third approach is the height of the backboard is determined by the placement of the locking nut member creating some difficulty in raising and lowering the backboard.

SUMMARY OF THE INVENTION

The present invention involves an adjustable height basketball standard that includes a lower tube secured to a ground surface. An upper tube engages the lower tube. A raising and lowering mechanism includes a friction element or clutch. The raising and lowering mechanism engages a handle that may be turned by the user. The friction element substantially resists downward movement of the upper tube unless the friction element is overridden through movement of the handle by the user. The friction element may be a wrap spring, a friction cone clutch, brake plates or shoes, or a similar device.

In one embodiment, the upper tube includes a series of notches. A drive mechanism includes a drive housing with a gear that engages successive ones of the notches as the drive housing is turned. When the drive housing is turned clockwise, the upper tube raises with respect to the lower tube, and when the drive housing is turned in counter-clockwise, the upper tube lowers with respect to the lower tube. More specifically, a spring is wrapped around the drive housing. When the handle is not turned, the spring resists counter-clockwise movement of the drive housing. When the handle turns clockwise, the spring turns with the drive housing.

When the handle is turned counter-clockwise, the spring initially resists movement of the drive housing in the counter-clockwise direction. However, after the handle turns about 15 degrees, the spring is momentarily released. The drive housing and release spring have interfacing teeth.

In one embodiment of the drive mechanism, a spring includes a tang that touches a tab in the release ring. The spring is overridden when the tab of the release ring presses against the tang. In an alternative drive mechanism, the release ring includes the tang which touches a tab in the spring. The spring is overridden when the tang of the release ring presses against the tab of the spring.

The drive mechanism includes a compressible dampener that serves at least three purposes. First, the compressible dampener returns the release ring to a neutral position when the user stops turning the handle. When the release ring is in the neutral position, the spring is tight preventing the drive housing from turning counter-clockwise. Consequently, the upper tube will not lower without the user turning the handle. Secondly, the compressible dampener prevents the spring from completely releasing, which would cause the upper tube to rapidly lower perhaps injuring someone. Thirdly, because the spring does not completely release, chatter is reduced as the upper tube lowers.

The upper tube may have either a larger or smaller diameter than the lower tube.

A cable may be used rather than gears. One end of the cable may be attached to the bottom of the upper tube. The other end of the cable is attached to a spool.

A single tube may be used with a movable bracket having a gear housing or a cable.

BRIEF DESCRIPTION OF THE DRAWINGS

FIG. 18 is a back view of the third embodiment of the present invention of FIG. 3.

DETAILED DESCRIPTION OF THE ILLUSTRATED EMBODIMENTS

Figure 1:
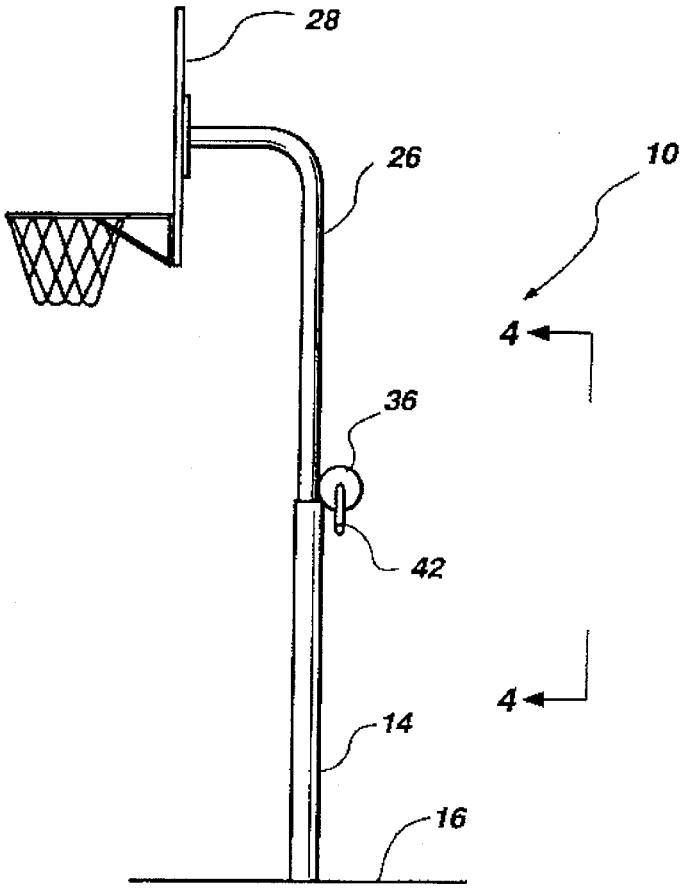
FIG. 1 is a side view of an adjustable height basketball standard according to a first embodiment of the present invention and in which a lower tube is partially buried in the ground.
Figure 2:
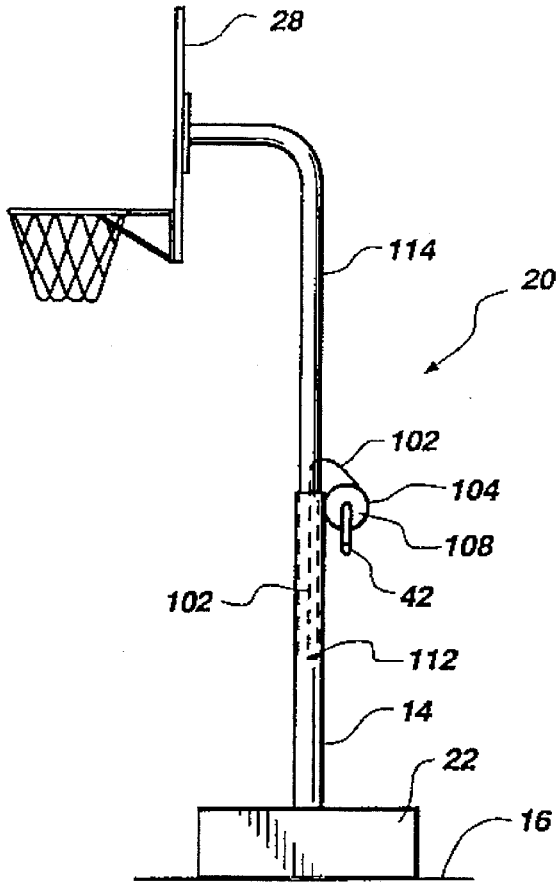
FIG. 2 is a side view of an adjustable height basketball standard according to a second embodiment of the present invention and in which the lower tube is attached to a moveable stand.

Referring to FIG. 1, an adjustable height basketball standard 10 includes a lower tube 14 secured to a ground surface 16. As used herein, "secured to the ground surface" includes both having lower tube 14 implanted into ground surface 16 as shown in FIG. 1 and having lower tube 14 of adjustable height basketball standard 20 connected to a movable support 22 on ground surface 16, as shown in FIG. 2, which is described below.

Figure 3:
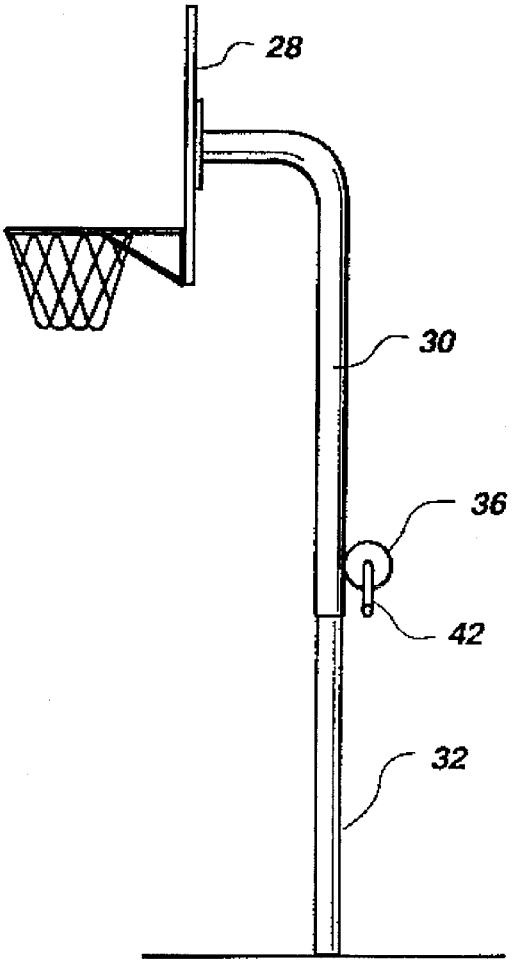
FIG. 3 is a side view of a third embodiment of the present invention.

Referring to FIG. 1, an upper tube 26, which supports a backboard 28, engages lower tube 14. The upper tube may have either a larger or smaller diameter than the lower tube. In FIG. 1, upper tube 26 has a smaller diameter than lower tube 14 and, therefore, part of upper tube 26 fits inside lower tube 14. In FIG. 3, upper tube 30 has a larger diameter than lower tube 32 and, therefore, part of lower tube 32 fits inside upper tube 30. As used herein, the upper tube "engages" the lower tube whether the upper tube has a smaller diameter (as in FIG. 1) or a larger diameter (as in FIG. 3).

Figure 4:
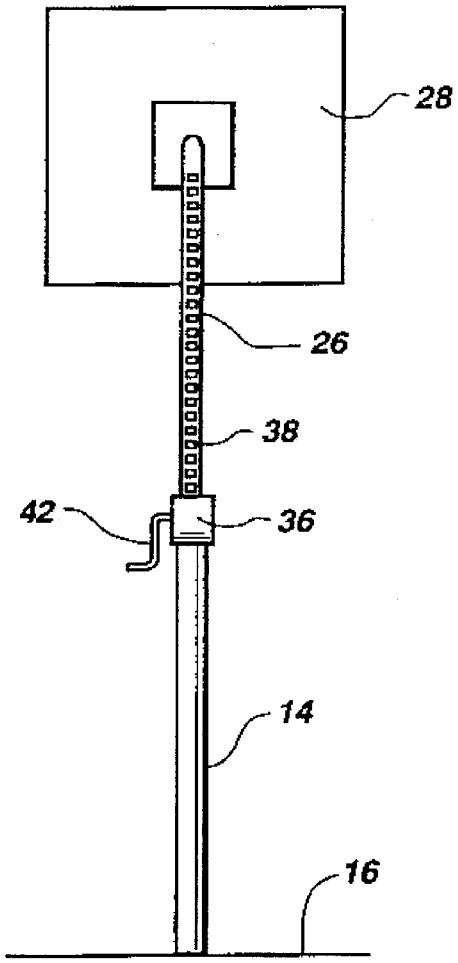
FIG. 4 is a back view of the first embodiment of the present invention taken along the lines 4—4 of FIG. 1.

The present invention includes a raising and lower mechanism that moves the upper tube with respect to the lower tube. For example, in FIG. 1, a raising and lower mechanism includes a drive mechanism 36. Drive mechanism 36 includes a gear 48 (shown in FIG. 5) which engages with notches 38 (shown in FIG. 4) in upper tube 26. FIG. 4 shows a back view of basketball standard 10 taken alone the lines 4—4 of FIG. 1. Instead of providing holes to a tube (such as notches 38 to upper tube 26 in FIG. 4), a rack with notches could be welded to the tube. Still alternatively, a chain could be welded or otherwise secured at least at its ends to the tube. Gear 48 or a similar gear could interact with the rack or chain.

FIG. 3 illustrates a third embodiment of the invention in which upper tube 30 has a larger diameter than lower tube 32. Upper tube 30 is raised or lowered by a gear 48 engaging notches 38 (see FIG. 18) in lower tube 32, similar to notches 38 on upper tube 26.

A handle 42 engages drive mechanism 36. When handle 42 is turned clockwise (as viewed from handle 42 toward drive mechanism 36), gear 48 moves so that upper tube 26 is raised. When handle 42 is turned counter-clockwise, gear 48 moves so that upper tube 26 is lowered. Drive mechanism may be constructed so that handle 42 may be inserted on either side. Therefore, the effect of turning clockwise or counterclockwise may be reversed.

Figure 5:
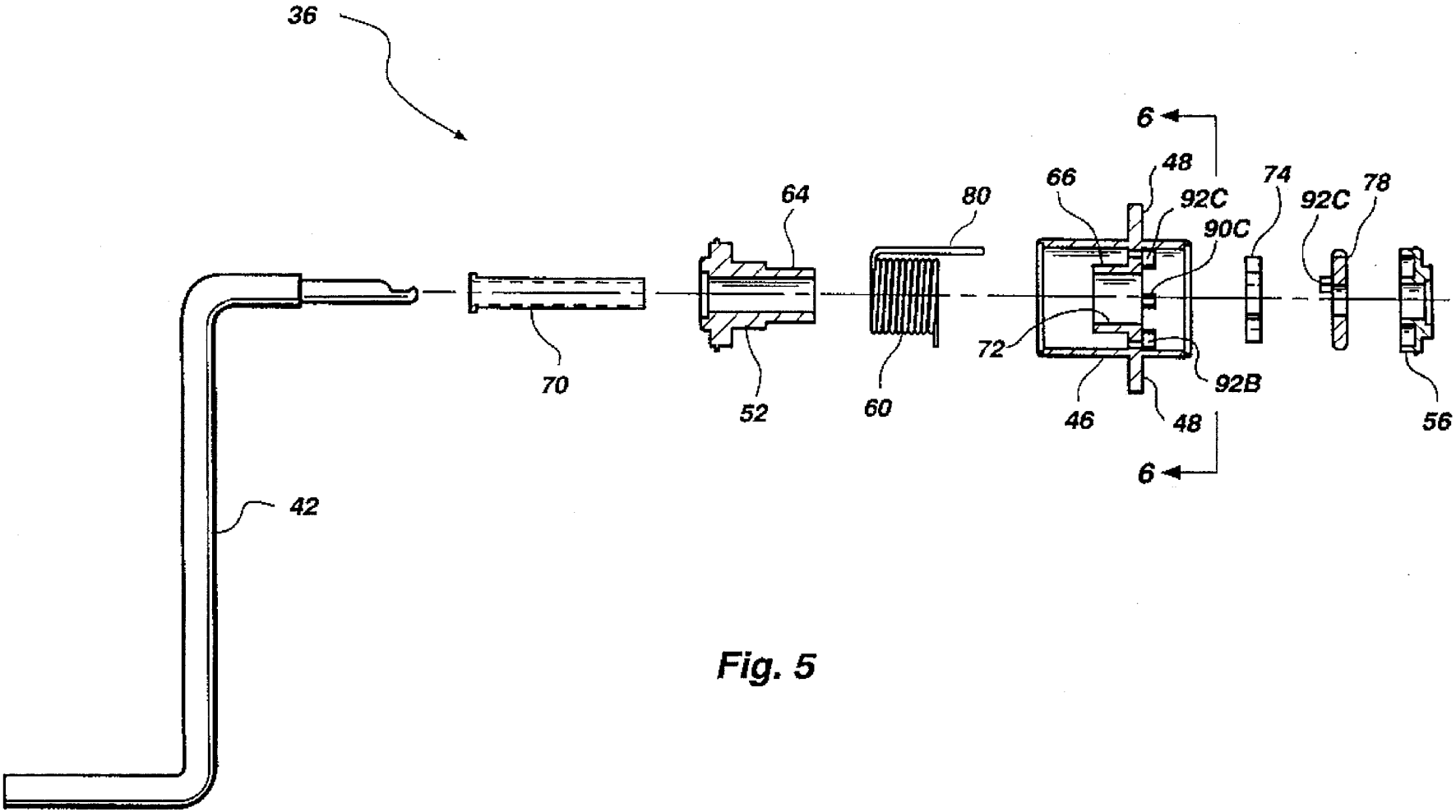
FIG. 5 is an exploded view of components of a drive mechanism according to the present invention.
Figure 6:
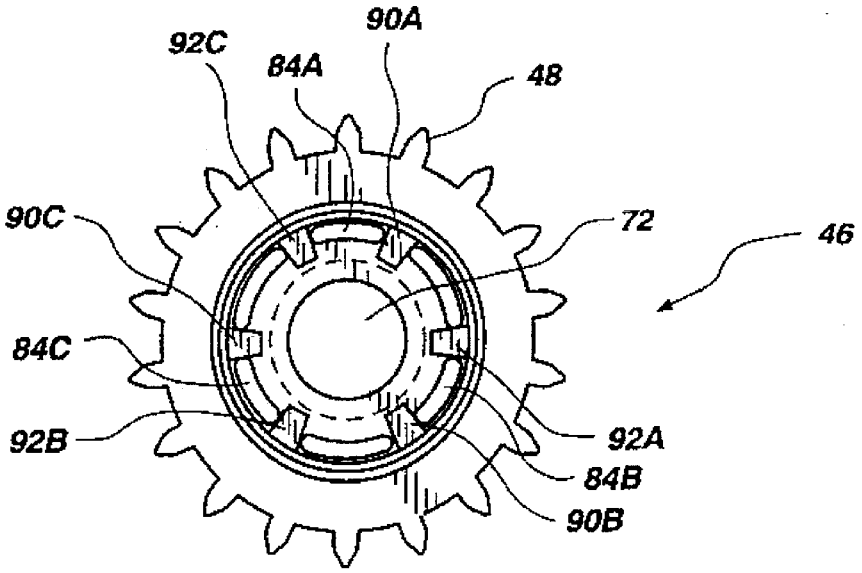
FIG. 6 is a front view of a drive housing taken along lines 6—6 of FIG. 5.
Figure 9:
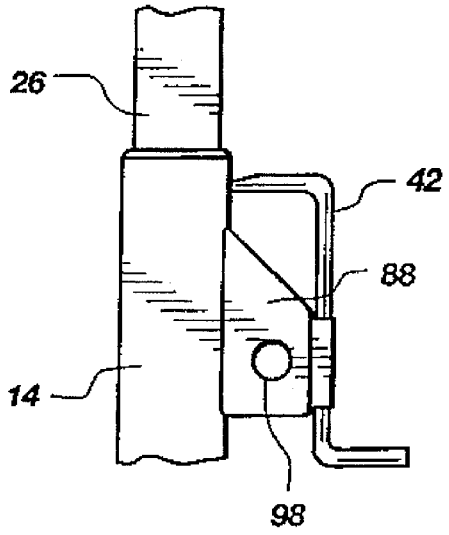
FIG. 9 is a side view of a lock for a drive mechanism according to the present invention.

FIG. 5 is an exploded cross-sectional view of drive mechanism 36. For safety reasons, drive mechanism 36 should be enclosed (as shown in FIG. 9) such that users cannot get their fingers caught in movable parts of drive mechanism 36. A drive housing 46 includes a gear 48. Drive housing 46 is also shown in FIG. 6, which is taken along lines 6—6 of FIG. 5. Referring to FIG. 5, drive housing 46 is supported by a secured hub 52 and a bushing 56. A spring 60 is wrapped around ledge 64 of hub 52 and ledge 66 of drive housing 46. The inside diameter of spring 60 is preferably smaller than the outside diameters of hub 52 and ledge 66.

Handle 42 engages a hex-shaped drive tube 70. Tube 70 fits through hub 52, an inner tube 72 of drive housing 46, a compressible dampener 74, and a release ring 78. Tube 70 engages with hex-shaped hole 82 in ring release 78 (shown in FIG. 3). Release ring 78 turns in response to tube 70 turning. A tang 80 of spring 60 extends through an opening 84A, 84B, or 84C in drive housing 46 and engages in a hole 86A, 86B, or 86C in release ring 78.

Figure 7:
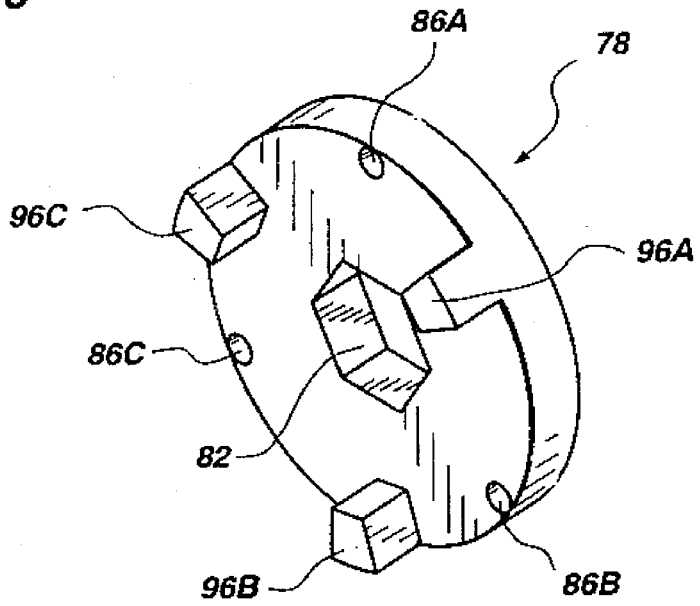
FIG. 7 is a perspective view of a release ring that is contained in the drive mechanism shown in FIG. 5.
Figure 8:
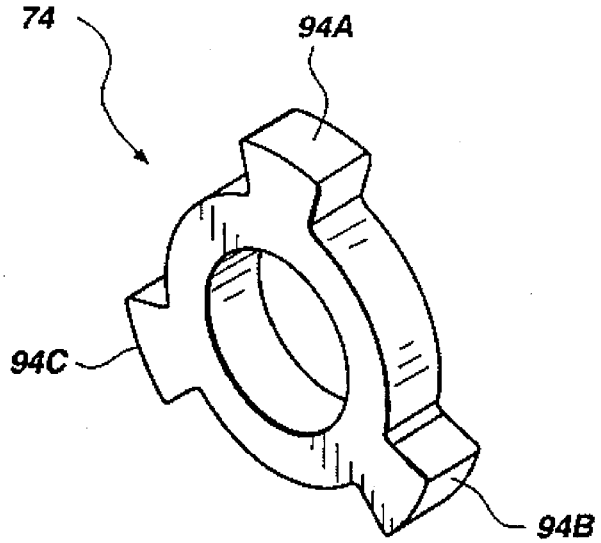
FIG. 8 is a perspective view of a compressible dampener that is contained in the drive mechanism shown in FIG. 5.

Referring to FIG. 6, drive housing 46 includes six teeth 90A and 92A, 90B and 92B, and 90C and 92C. As shown in FIG. 7, release ring 78 includes three teeth 96A, 96B, and 96C. As shown in FIG. 8, compressible dampener 74 includes three teeth 94A, 94B, and 94C. When they are assembled, teeth 94A and 96A fit between teeth 90A and 92A of drive housing 46. Likewise, teeth 94B and 96B fit between teeth 90B and 92B, and teeth 94C and 96C fit between teeth 90C and 92C.

When handle 42 is not being turned, any counterclockwise movement of spring 60 makes spring 60 grasp tighter against ledge 66 preventing counterclockwise movement of gear 48 and lowering of upper tube 26.

When handle 40 is turned counter-clockwise, teeth 96A, 96B, and 96C of ring release 78 press against teeth 94A, 94B, and 94C, respectively, of compressible dampener 74, which in turn touch teeth 92A, 92B, and 92C of drive housing 46. Drive housing 46 does not move until compressible dampener 74 is compressed. Initially, spring 60 resists movement of drive housing 46 in the counter-clockwise direction. However, after release ring 78 has turned, for example, about 15 degrees, spring 60 is momentarily released.

When handle 40 is turned clock-wise, teeth 96A, 96B, and 96C of ring release press 78 against teeth 90A, 90B, and 90C, respectively, of drive housing 46. This causes the teeth of gear 48 closest to notches 38 to turn upward raising upper tube 26. Spring 60 does not provide resistance because release ring 78 turns tang 80 in a direction which overrides spring 60.

Compressible dampener 74 serves at least three purposes. First, compressible dampener 74 returns release ring 78 to a neutral position when the user stops turning handle 42. When release ring 78 is in the neutral position, spring 60 is tight preventing drive housing 46 from turning counter-clockwise. Consequently, tube 26 will not lower without the user turning handle 42. (The downward force of tube 26 caused by gravity prevents drive housing 46 from turning clockwise while release ring 78 is in the neutral position.)

The second purpose is that compressible dampener 74 prevents spring 60 from completely releasing, which would cause tube 26 to rapidly lower perhaps injuring someone. The third purpose, which is related to the second purpose, is that because spring 60 does not completely release, the upper tube does not chatter as it lowers.

Referring to FIG. 9, as an added precaution against tube 26 lowering when it should not, drive mechanism 36 may include a ridge in an outer cover 88 that allows handle 42 to be placed to that on end of handle 42 is inserted into notches 38. With the end of handle 42 inserted into notches 38, upper tube 26 does not move with respect to lower tube 14, even if drive mechanism 36 fails. When desired, the handle may be inserted into hole 98 to engage drive mechanism 36 to raise or lower upper tube 26.

Compressible dampener 74 is preferably made of a millable urethane type rubber. Other parts in drive mechanism 36 may be made of distalloy or stamped metal. Spring 80 may be about 2.5 millimeters thick and may be music wire, particularly high carbon high tensile strength ASTM standard A228 music wire. Spring 80 may wrap around ledge 64 of hub 52 and ledge 66 of drive housing 46 approximately twelve times. The upper and lower tubes may be made of steel tubing.

Release ring 78 and compressible dampener 74 are preferably separate pieces. However, a single piece could perform the functions of release ring 78 and compressible dampener 74. For example, release ring 78 could have a compressible element 75 attached to it so that compressible dampener 74 is not necessary.

FIG. 2 illustrates a second embodiment of the invention in which one end of a cable 102 is attached to a spool 104 that is rotated by drive mechanism 108. Drive mechanism 108 is similar to drive mechanism 36 except that the drive housing of drive mechanism 108 turns spool 104 rather than engaging with notches 38. The other end of cable 102 is attached to upper tube 114 at, for example, bottom 112 of upper tube 114. When handle 42 is turned in one direction (e.g., clockwise), cable 102 is pulled onto spool 104 and cable 102 pulls upper tube 114 up. When handle 42 is turned in the other direction, gravity pulls upper tube 114 down as some of cable 102 moves off of spool 104. For safety reasons, spool 104 and drive mechanism 108 are preferably covered.

Figure 10:
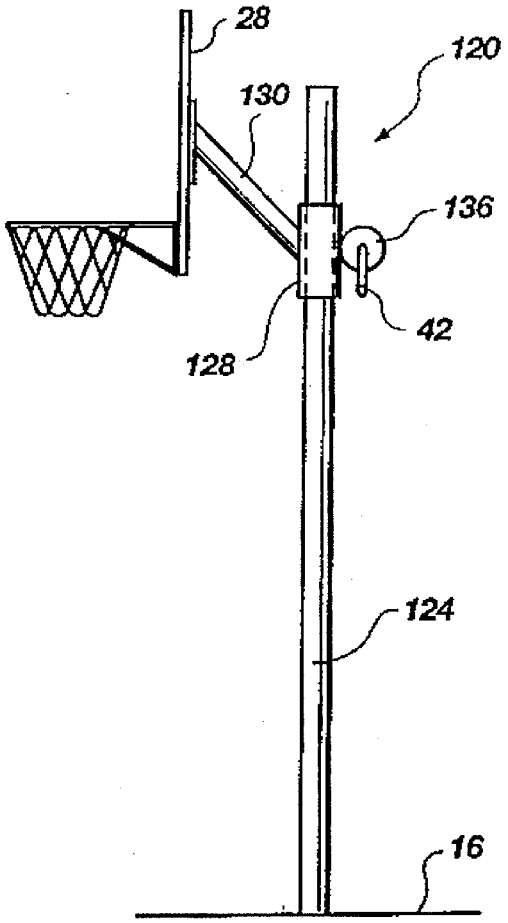
FIG. 10 is a side view of an adjustable height basketball standard according to a fourth embodiment of the present invention.

Referring to FIG. 10, in a fourth embodiment, an adjustable height basketball standard 120 includes a single tube 124 and a mobile bracket 128 that supports backboard 28 through support tube 130. Mobile bracket 128 moves up and down tube 124 as a result of rotation of a drive mechanism 136, which operates the same as drive mechanism 36. Tube 124 include notches, similar to notches 38, shown in FIG. 4.

Figure 11:
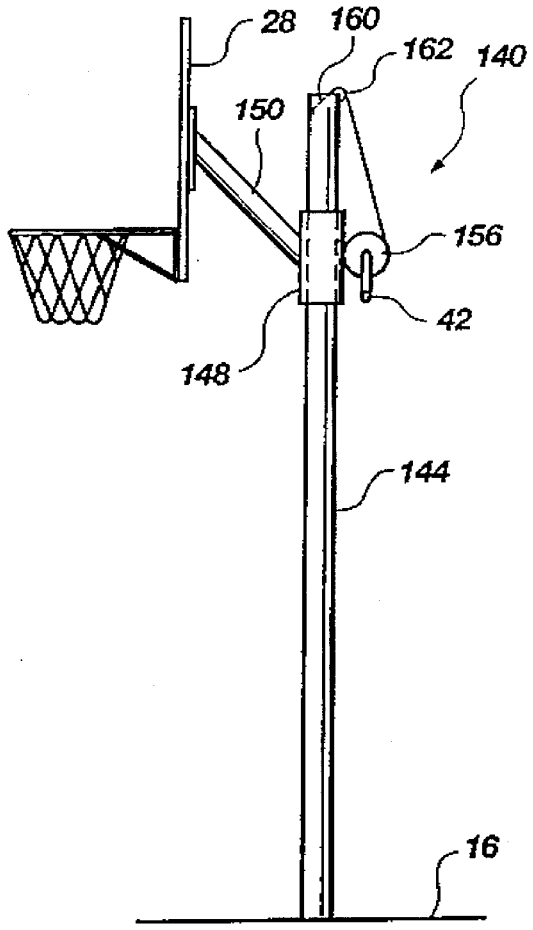
FIG. 11 is a side view of an adjustable height basketball standard according to a fifth embodiment of the present invention.

Referring to FIG. 11, in a fifth embodiment, an adjustable height basketball standard 140, includes a single tube 144 and a mobile bracket 148 that supports backboard 28 through support tube 150. Mobile bracket 148 moves up and down tube 144 as a result of rotation of a drive mechanism 156, which operates the same as drive mechanism 108. A cable 160 connects a spool of drive mechanism 156 with a stationary member, such as tube 144 or a support to which tube 144 is attached. Cable 160 may partially extend around pulley 162. The end of cable 160 may connect to tube 144 near the top of tube 144 or at some lower position on tube 144.

The embodiments described herein have only two tubes or a tube and a bracket. The principles of the invention, however, would extend to an adjustable height basketball standard having more than two tubes, wherein there is some overlap among the tubes. Also, to allow small packaging, a tube may be constructed of more than one sub-tubes joined by swages.

Referring to FIG. 2, support 22 may include rollers for ease in transportation. To keep support 22 stationary during the time basketball is being played, support 22 should include heavy weight. The weight could be provided by water in a large cavity in support 22. Alternatively, ice cooler(s) holding ice and canned drinks could be placed on support 22. Also, the cavity may hold sand, dirt, or gravel which are less like to leak than liquids. Basketball standard 20 may be partially collapsible by having lower tube 14 tilt back when basketball standard 20 is not in use.

Figure 12:
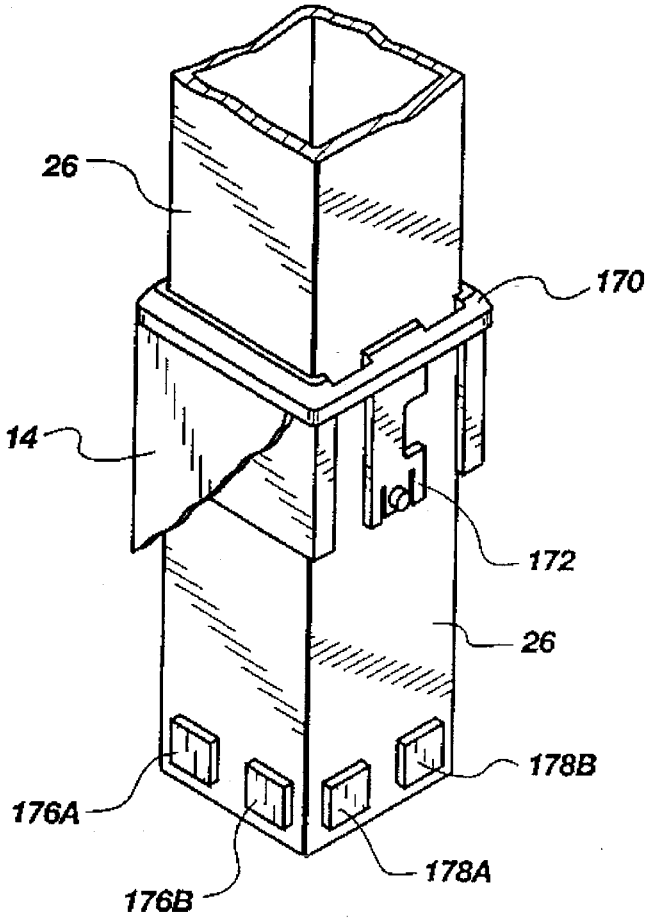
FIG. 12 is a perspective view in cut-a-way of a bushing collar bracket and bushing slides on the ends of tubes that reduce wobbling.

To keep the upper tube from moving horizontally an intolerable amount, there must be at least some overlap of the upper and lower tubes. Referring to FIG. 12, a bushing collar bracket 170 is placed inside the upper end of lower tube 14 and bushing slides 176A, 176B, 178A, and 178B are placed on the bottom of upper tube 26. (Additional bushing slides the same as bushing slides 176A, 176B, 178A, and 178B are placed on the other two sides of upper tube 26 in the same position as bushing slides 176A, 176B, 178A, and 178B.) Bushing collar bracket 170 includes a space to allow the teeth of gear 48 to interact with notches 38. A strip 172 may be included to provide extra contact with lower tube 14. Bushing collar bracket 170 and slides 176A, 176B, 178B, 178B, and the additional bushing slides not shown, prevent wobbling between upper tube 26 and lower tube 14. 0f course, other similar arrangements of bushings could be made to prevent wobbling. Bushing collar bracket 170 may be made of plastic, nylon, high density polyethylene, bronze, or another bearing material. Slides 176A, 176B, 178A, and 178B may be made of a bushing material such as high density polyethylene.

The tubes illustrated herein have square cross-sections. However, tubes having other cross-sectional shapes such as circular cross-sections may be used. An advantage of square tubing is that it prevents rotation.

Figure 13:
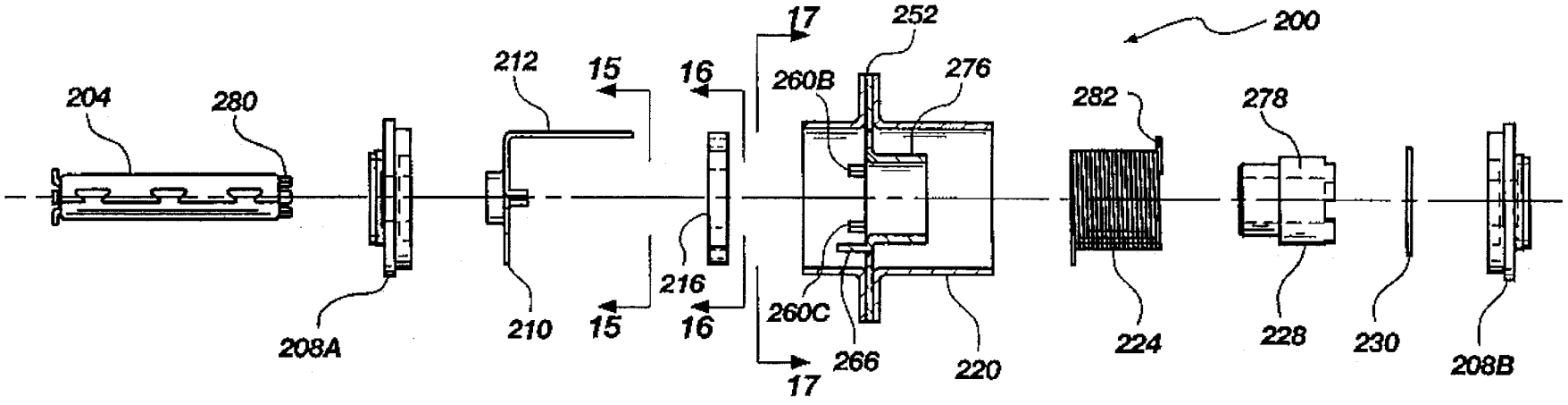
FIG. 13 is an exploded view of components of an alternative drive mechanism according to the present invention.
Figure 14:
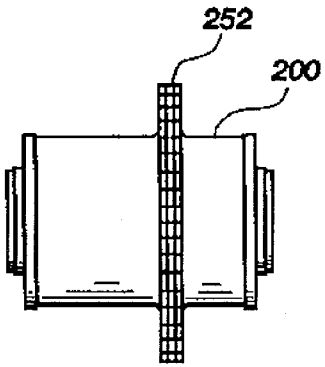
FIG. 14 is a side view of the alternative drive mechanism of FIG. 13 in unexploded form.

Referring to FIGS. 13 and 14, an alternative drive mechanism 200 includes a hex-shaped drive tube 204 which is inserted through bushing 208A, a release ring 210 having a tang 212, a compressible dampener 216, a cranking sprocket 220, a wrap spring 224, a clutch hub 228, a shim washer 230, and bushing 208B. Bendable tabs 280 may be bent around the inside of bushing 208B to secure the components together. Also, an optional push nut may be placed over the end of busing 208B. Drive tube 204 may be constructed of a single sheet of stamped metal connected in dove tail as shown in FIG. 13.

Figure 15:
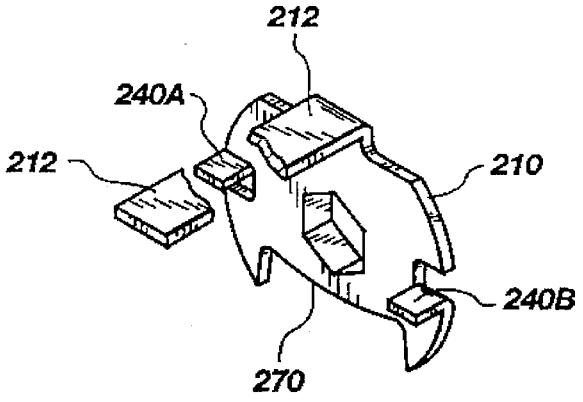
FIG. 15 is a perspective view of a release ring of FIG. 13 taken along lines 15—15.
Figure 16:
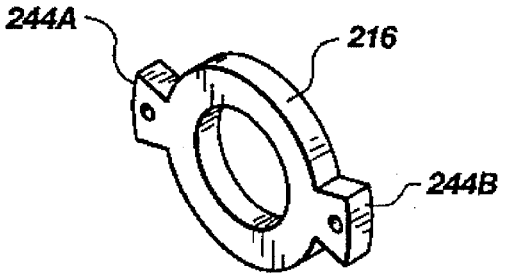
FIG. 16 is a perspective view of a compressible dampener of FIG. 13 taken along lines 16—16.

Referring to FIG. 15, release ring 210 includes tabs 240A and 240B which extend toward cranking sprocket 220. Referring to FIG. 16, compressible dampener 216 includes teeth 244A and 244B. Holes in teeth 244A and 244B direct the shape of teeth 244A and 244B when they are compressed. Tabs 240A and 240B restrict movement of compressible dampener 216.

Figure 17:
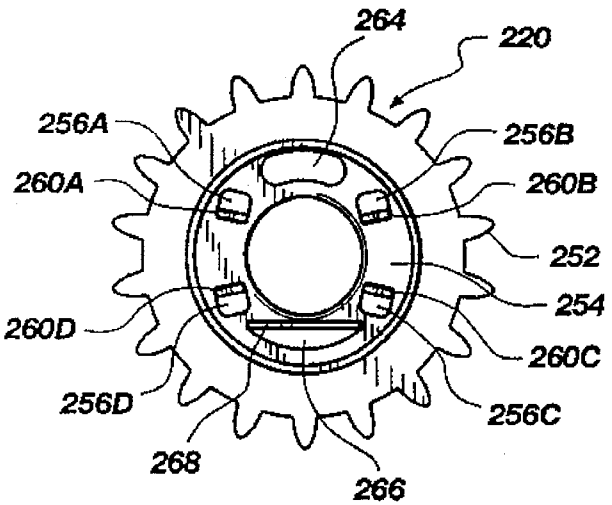
FIG. 17 is a view of a cranking sprocket of FIG. 13 taken along lines 17—17.

Referring to FIG. 17, cranking sprocket 220 includes gear teeth 252 and punch out sections 256A, 256B, 256C, and 256D in surface 254 with corresponding tabs 260A, 260B, 260C, and 260D. A slot 264 receives tang 212 and a tab 268 extends from a hole 266 in surface 254. Tab 268 fits inside a cut-out section 270 of release ring 210. Teeth 244A and 244B are placed between tabs 260A, 260B, 260C, and 260D.

As shown in FIG. 13, handle 42 will enter from the right side of FIG. 13 through bushing 208B. The inside diameter is spring 224 is preferably smaller than the outside diameter of surface 278 of clutch hub 228 and surface 276 of cranking sprocket 220. When handle 42 is not turned, downward force from gravity on upper tube 26 tightens spring 224 around surface 278 and surface 276 preventing rotation of gear teeth 252. If handle 42 is turned in the direction tending to move upper tube 26 upward, spring 224 is not tighten and tube 26 moves upward. If handle 42 is rotated in the opposite direction, after slight (e.g. 15 degrees) rotation, tang 212 rotates against tab 282 of spring 224 which causes spring 224 to momentarily loosen around surface 278. In that case, spring 224 is said to be overridden. Compressible dampener 216 operates in a manner similar to that of compressible dampener 74.

The alternative drive mechanism 200 is preferred over drive mechanism 36 in that tang 212 on release ring 210 may be much more rigid than tang 80 on spring 60. The extra rigidity decreases chatter.

Hex-shaped drive tube 204, release ring 210, and cranking sprocket 220 may be made of mild steel stamping. Bushings 208A and 208B may be made of graphite impregnated powered metal. Clutch hub 228 may be made of oil impregnated powered metal. Compressible dampener 216 may be made of millable urethane. Wrap spring 224 may be about 2.5 millimeters thick and may be music wire, particularly high carbon high tensile strength ASTM standard A228 music wire.

The present invention is not restricted to basketball standards but may be used for other sporting goods, such as volleyball and teatherball equipment.

Many variations and modifications may be made to the instant invention without departing from the spirit of the invention and the scope of the following claims.

What is claimed is:

1. An adjustable height basketball standard supported by a ground surface, comprising:

a lower tube secured to the ground surface;

an upper tube partially engaging the lower tube;

a backboard connected and supported by said upper tube; and a raising and lowering mechanism that engages a handle disposed for turning by a user, wherein the raising and lowering mechanism includes friction element means for substantially resisting downward movement of the upper tube unless the friction element means is overridden through movement of the handle by the user, wherein said friction element means includes a tab, and wherein the raising and lowering mechanism further includes a compressible dampener and a release element rotatable with turning of the handle, and wherein the release element rotates against the tab after the compressible dampener is compressed causing the friction element means to be overridden.

2. The adjustable height basketball standard of claim 1 wherein at least one of said upper tube and said lower tube includes a series of notches and in which the raising and lowering mechanism includes a drive housing with a gear that engages successive notches as the drive housing is rotated.

3. The adjustable height basketball standard of claim 2 wherein the lower tube has a diameter greater than that of the upper tube, wherein said upper tube includes the series of notches.

4. The adjustable height basketball standard of claim 1 wherein the friction element means is a wrap spring.

5. The adjustable height basketball standard of claim 1 wherein the upper and lower tubes have square cross-sections.

6. The adjustable height basketball standard of claim 1 wherein the raising and lowering mechanism includes a spool and a cable, one end of which is attached to the spool and an other end of which is attached to the upper tube.

7. An adjustable height basketball standard supported by a ground surface, comprising:

a lower tube secured to the ground surface;

an upper tube partially engaging the lower tube;

a backboard attached to and supported by said upper tube; and a raising and lowering mechanism that engages a handle disposed for turning by a user, wherein the raising and lowering mechanism includes friction element means for substantially resisting downward movement of the upper tube unless the friction element means is overridden through movement of the handle by the user, wherein the friction element means includes a spring having a tab that is wrapped around a drive housing associated with the raising and lowering mechanism and the raising and lowering mechanism further includes a release ring with a tang that rotates when the user turns the handle and said release ring includes a compressible layer, and wherein the drive housing readily rotates when the handle is turned in a first direction and has means for initially holding, but later turning when the handle is turned in a second direction causing the tang to rotate against the tab.

8. The adjustable height basketball standard of claim 7 wherein at least one of said upper tube and said lower tube includes a series of notches and in which the raising and lowering mechanism includes a drive housing with a gear that engages successive notches as the drive housing is rotated.

9. The adjustable height basketball standard of claim 8 wherein the upper tube has a diameter greater than that of the lower tube, wherein said lower tube includes the series of notches.

10. The adjustable height basketball standard of claim 8 wherein the lower tube has a diameter greater than that of the upper tube, wherein said upper tube includes the series of notches.

11. The adjustable height basketball standard of claim 7 wherein the upper and lower tubes have square cross-sections.

12. The adjustable height basketball standard of claim 7 wherein the raising and lowering mechanism includes a spool and a cable, one end of which is attached to the spool and an other end of which is attached to the upper tube.

13. Adjustable height sports equipment supported by a ground surface, comprising:

a lower tube secured to the ground surface;

an upper tube partially engaging the lower tube; and a raising and lowering mechanism that engages a handle disposed for turning by a user, said raising and lowering mechanism including a friction element means for substantially resisting downward movement of the upper tube unless the friction element means is overridden through movement of the handle by the user, wherein the friction element means includes a tab and the raising and lowering mechanism further includes a compressible dampener and a release element that rotates in response to turning of the handle, and wherein the release element rotates against the tab after the compressible dampener is compressed thus overriding the friction element means.

* * * * *

UNITED STATES PATENT AND TRADEMARK OFFICE

CERTIFICATE OF CORRECTION

PATENT NO. : 5,540,429

DATED : July 30, 1996

INVENTOR(S) : Dalebout, et al

Figure 19:
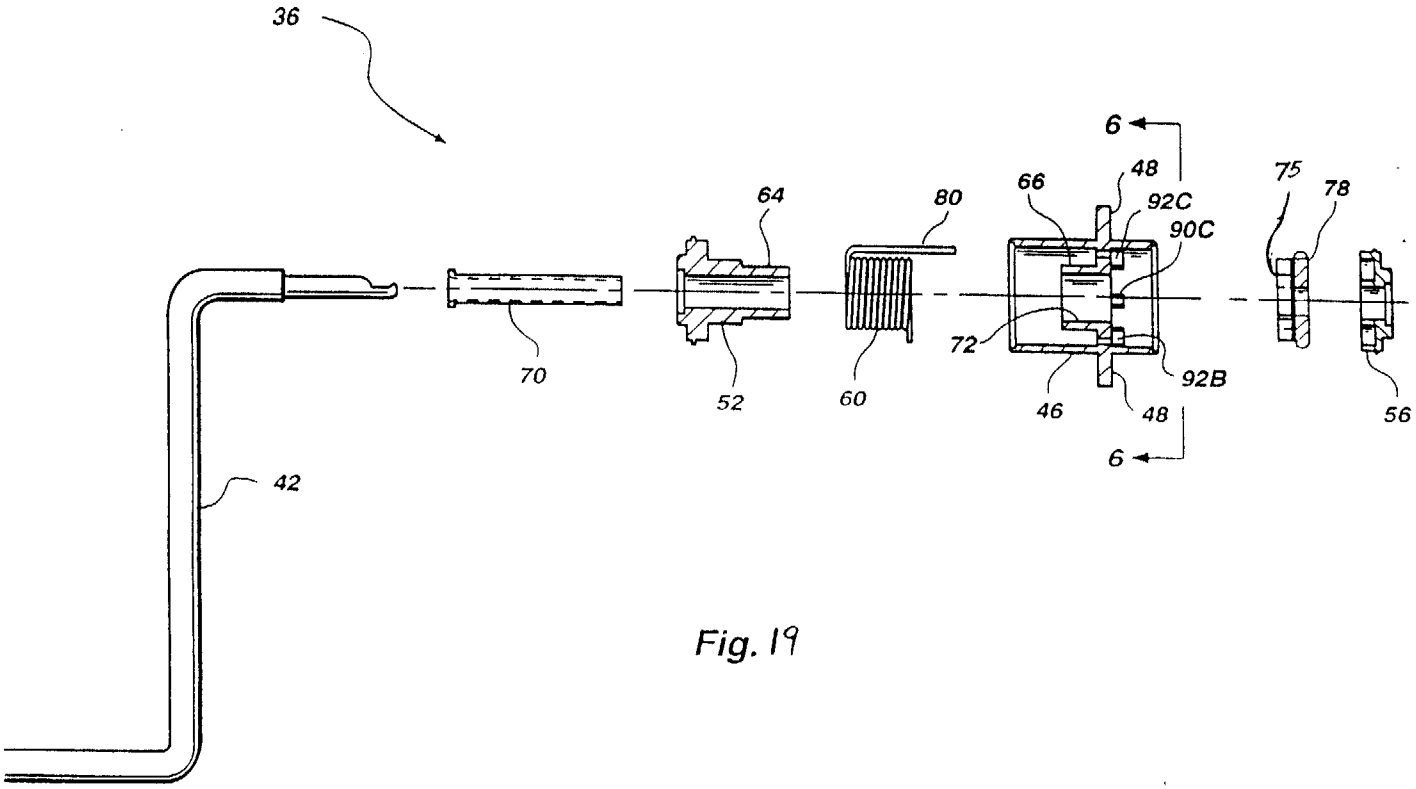
FIG. 19 is an exploded view of the components of an alternate drive mechanism according to the present invention

It is certified that error appears in the above-indentified patent and that said Letters Patent is hereby corrected as shown below:

Add the Drawing Sheets, consisting of Figure 18 and 19, as shown on the attached pages.

UNITED STATES PATENT AND TRADEMARK OFFICE

CERTIFICATE OF CORRECTION

PATENT NO. : 5,540,429

DATED : July 30, 1996

INVENTOR(S) : Dalebout et al

It is certified that error appears in the above-indentified patent and that said Letters Patent is hereby corrected as shown below:

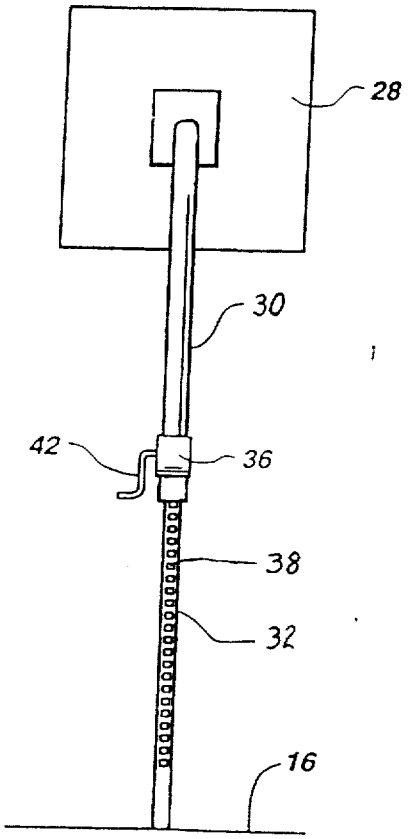

*Fig. 18*

UNITED STATES PATENT AND TRADEMARK OFFICE

CERTIFICATE OF CORRECTION

PATENT NO. : 5,540,429
DATED : July 30, 1996
INVENTOR(S) : Dalebout et al.

It is certified that error appears in the above-indentified patent and that said Letters Patent is hereby corrected as shown below:

After Sheet 7 of 7, insert the drawings of FIGS. 18 and 19;

In the Abstract, line 15, after "turned" delete "in";

In the Abstract, line 24, change "to be" to --is--;

In col. 1, line 62, after "turned" delete "in";

In col. 3, lines 39 and 41, change "lower" to --lowering--;

In col. 4, line 15, change "FIG. 3" to --FIG. 7--;

In col. 4, lines 32 and 42, change "40" to --42--;

In col. 4, line 43, change "press 78" to --78 press--;

In col. 5, line 1, after "placed" change "to" to --so-- and after "that" change "on" to --one--;

In col. 5, lines 9 and 12, change "80" to --60--;

In col. 6, line 2, after "less" change "like" to --likely--;

In col. 6, line 17, change "178B" to --178A--;

In col. 6, line 38, change "busing" to --bushing--; and

In col. 6, line 64, change "tighten" to --tightened--.

Signed and Sealed this

Second Day of September, 1997

Bruce Lehman

*Attest:*

BRUCE LEHMAN

*Attesting Officer*

*Commissioner of Patents and Trademarks*